United States Patent [19]

Nussbaum

[11] 4,097,201

[45] Jun. 27, 1978

[54] COMBINED WELL PUMP HOUSING AND AERATION MEANS

[76] Inventor: Gerald F. Nussbaum, R.R. 6, Defiance, Ohio 43512

[21] Appl. No.: 645,999

[22] Filed: Jan. 2, 1976

[51] Int. Cl.[2] ..... F04B 47/00

[52] U.S. Cl. ..... 417/360

[58] Field of Search ..... 166/107, 314; 417/431, 417/360, 435, 902, 313, 53, 54, 108, 572; 222/190; 261/37; 55/73

[56] References Cited

U.S. PATENT DOCUMENTS

| | | | |
|---|---|---|---|
| 2,744,065 | 5/1956 | Lacey | 417/108 X |
| 3,102,799 | 9/1963 | Kiekhaefer | 417/38 X |
| 3,624,822 | 11/1971 | Carle et al. | 417/313 |
| 3,749,522 | 7/1973 | Kazama et al. | 417/54 |

FOREIGN PATENT DOCUMENTS

| | | | |
|---|---|---|---|
| 543,770 | 2/1927 | Germany | 417/313 |
| 487,686 | 11/1929 | Germany | 417/360 |

*Primary Examiner*—William L. Freeh
*Assistant Examiner*—Edward Look
*Attorney, Agent, or Firm*—Clarence A. O'Brien; Harvey B. Jacobson

[57] ABSTRACT

An upwardly opening container is provided and positioned in a water well below the water level therein. The container is cylindrical in configuration and a cylindrical water pump is received downwardly within the container and includes an inlet spaced below the open upper end of the container. The water pump includes an outlet to which a water delivery line is connected and an air supply line extends downwardly into the well to a point below the lower end of the container and has its upper end communicated with the discharge port of an air compressor adjacent the upper end of the well. The upper end of the well is closed by means of a well cap and a standpipe vent has its lower end secured downwardly through the well cap. The pump includes an integral electric driving motor and is electrically connected to an above-ground source of electrical potential and under the control of any suitable controlling mechanism. The air compressor is electrically driven and may be electrically driven throughout each operation of the pump motor, or may be electrically driven under the control of a separate time control. Aeration of the lower end of the interior of the well below the container which houses the well pump is carried out in order to purge the well water of corrosive gases such as sulphur gas and the pump is housed within the upwardly opening container in order to prevent the pump from intaking air being discharged into the well water.

9 Claims, 3 Drawing Figures

18
20
42
38
24
22
16
14
28
60
58
10
56
12
40
54
52
48
26
46
50
30
34
36

COMBINED WELL PUMP HOUSING AND AERATION MEANS

BACKGROUND OF THE INVENTION

Some water wells are subject to contamination by sulphur gas and the corrosive properties of sulphur gas can cause copper water lines and other metal fixtures within a residence served by the water well to be corroded at an excessive rate.

While the concept of aerating water wells by discharging air under pressure into the well water has been heretofore practiced as disclosed in U.S. Pat. Nos. 1,365,210, 1,428,238, 1,593,820, 1,753,930 and 2,050,526, these previously taught concepts of the aeration of well water have not provided means to prevent air discharged into the bottom of a well below the water pump therein from being drawn into the intake of the water pump. Consequently, lubrication of the internal working components of the water pumps has not been assured, many submersible water pumps relying upon continuous lubrication by the water being pumped through the pumps.

BRIEF DESCRIPTION OF THE INVENTION

The water well aeration concept of the instant invention includes the discharging of air under pressure in a lower end portion of a water well, as has been previously practiced, but includes an upwardly opening container for supporting a submersible water pump therein with the container and the submersible water pump disposed therein being positioned below the water level in the well. In this manner, air may be discharged into the bottom of the well for aerating the water and thus purging the water of sulphur gas contaminating the water without the air bubbling upwardly through the well being drawn into the intake of the submersible pump, which intake is disposed inwardly of a lower end portion of the container. The upper portion of the well is capped and includes an air and gas venting standpipe having its lower end opening downwardly through the well cap.

The main object of this invention is to provide a means for aerating the water at the bottom of a water well and preventing the air discharged into the water from being drawn into the intake of the submersible water pump spaced above the level at which air is discharged into the well.

Another object of this invention, in accordance with the immediately preceding object, is to provide an upstanding open top cylindrical container downwardly into which a submersible water pump may be readily received.

Another object of this invention is to provide a means whereby air being discharged into the water in the bottom of the well as well as sulphur gas removed from the water to be vented from the upper end of the well.

A final object of this invention to be specifically enumerated herein is to provide a water well aeration assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
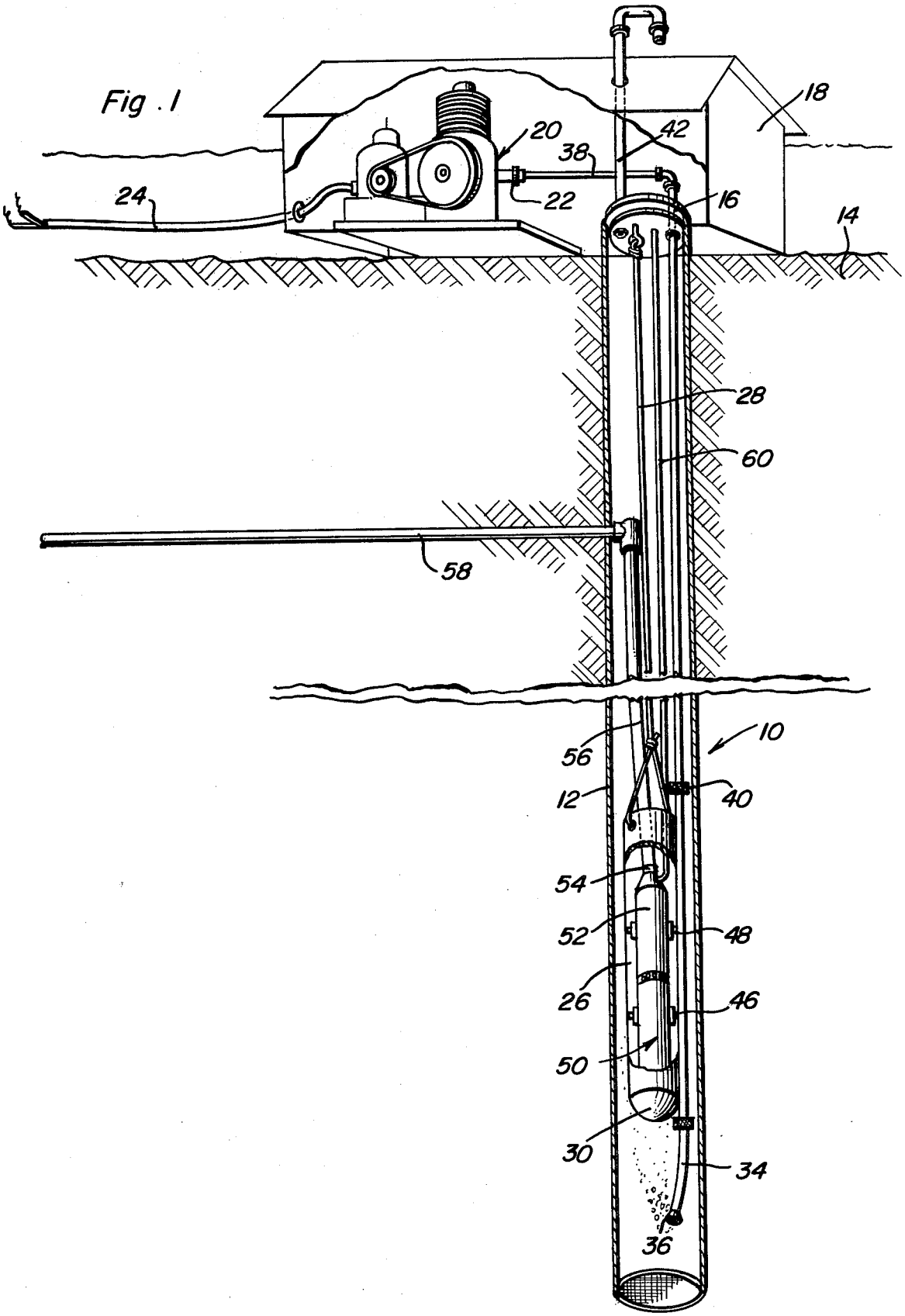
FIG. 1 is a vertical sectional view taken substantially upon a plane passing through the center of a water well and with the aeration structure of the instant invention operatively associated with the submersible pump of the well and the well cap closing the upper end of the well.
Figure 2:
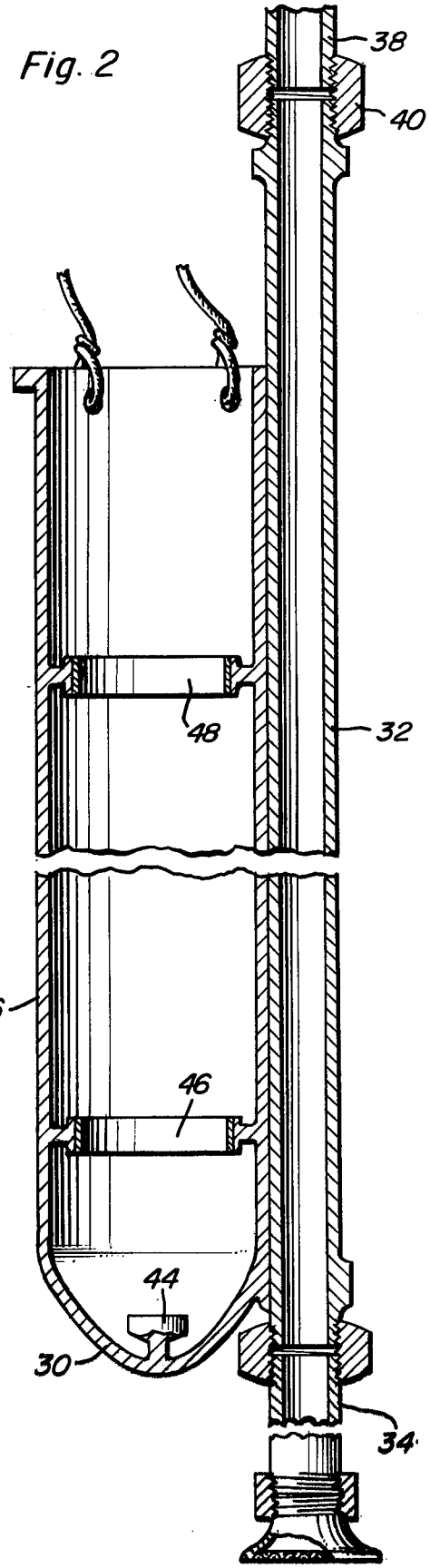
FIG. 2 is an enlarged fragmentary vertical sectional view of the submersible pump receiving upwardly opening container to be suspended in the lower portion of the well.
Figure 3:
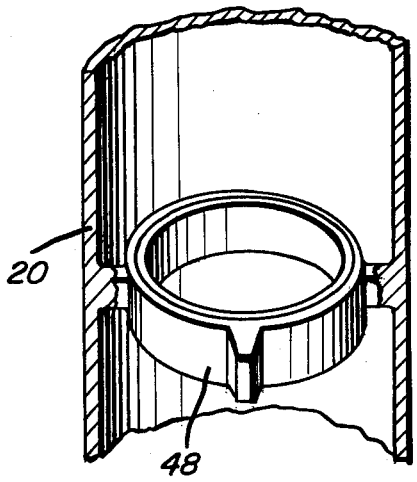
FIG. 3 is a fragmentary perspective view of the submersible pump holding container portion of the invention and illustrating one of the pump holder sections thereof.

Referring now more specifically to FIG. 1, the numeral 10 generally designates a water well including a well pipe 12 extending down into the ground 14 and including a cap structure 16 at its upper end spaced above the ground 14. The cap structure 16 is disposed within a pump house 18 housing an electric motor and compressor assembly referred to in general by the reference numeral 20 and including a compressed air outlet 22. The assembly 20 includes an electric cable 24 connected to any suitable source of electrical potential.

An upwardly opening cylindrical container 26 is suspended in the lower end of the well pipe 12 by means of a support cable or rope 28 and the container 26 includes a closed rounded lower end 30. In addition, the container includes an exterior pipe section 32 supported therefrom and extending therealong and the lower end of the pipe section 32 has a discharge section 34 coupled thereto terminating downwardly in an air screen and outlet assembly 36 disposed centrally in the well pipe 12 below the container 26.

The compressed air outlet 22 of the assembly 20 has the inlet end of an air line 38 coupled thereto and the air line 38 extends downwardly through the cap structure 16 and has its lower end coupled to the upper end of the pipe section 32 as at 40.

The upper end of the well 10 includes a vertical standpipe 42 opening upwardly through the roof of the pump house 18 and having its lower end opening downwardly through the cap structure 16, the standpipe 42 being utilized to vent the interior of the well pipe 12.

The interior of the container 26 includes a lower central support 44 supported from the bottom wall 30 and a pair of vertically spaced sleeve supports 46 and 48 supported within the container 26 in spaced relation relative to the inner surfaces thereof, the sleeve supports 46 and 48 being concentrically disposed relative to the container 26.

A submersible water pump referred to in general by the reference numeral 50 of conventional design and driven by an electric motor (not shown) is housed within a cylindrical casing 52 removably telescoped downwardly into the container 26 for supportive engagement by the supports 44, 46 and 48. A lower end portion of the casing 52 includes the water inlet (not shown) for the submersible pump 50 and the outlet 54 for the submersible pump 50 opens outwardly of the upper end of the casing or housing 52. The lower end of a water line 56 extending upwardly through the well pipe 12 is coupled to the outlet 54 and the water line or pipe 56 includes an upper horizontal portion 58 thereof which opens outwardly through a side wall portion of the well pipe 12.

In operation, the motor for the pump 50 is actuated electrically by means of an electric cable 60 extending downwardly through the cap structure 16 and electrically connected to the motor through the housing or casing 52 and any suitable control may be utilized to actuate the pump 50. Further, whatever control is utilized to actuate the pump 50 may also be utilized to actuate the motor and pump assembly 20 whereby the water within the well pipe 12 will be aerated whenever the pump 50 is actuated. However, it is deemed advisable, in most instances, to provide a timing mechanism for the motor and pump assembly 20 whereby its operation will be effected at predetermined time intervals.

Inasmuch as the inlet for the pump 50 is disposed within a lower portion of the casing 26 and air bubbling upwardly through the water within the well 10 continues to bubble upwardly past the open upper end of the container 26, the air utilized to aerate the water in the well may not be drawn into the intake of the pump and result in failure in the lubrication of the pump. Further, the air discharge into the water of the well serves to purge the well water of corrosive sulphur gas, the standpipe 42 serving to vent the upper end of the well pipe 12 in order that air pumped down into the well as well as sulphur gas may be vented from the upper end of the well.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a water well of the type subject to contamination by sulphur gas and including an upper end communicated with ambient above ground air, a closed bottom container disposed in said well below the water level therein, a water pump disposed within said container, said pump including a water intake below the upper portion of said pump and a water outlet, a water line in said well having an inlet end connected to said outlet, and said container including an upwardly opening water inlet spaced above said intake, a compressed air outlet disposed in said well below said container, and air pump and compressed air conduit means operative to pump ambient above ground air down into said well under pressure, said air conduit means being communicated with said air outlet.

2. The combination of claim 1 wherein said water inlet is defined by an open upper end of said container through which said pump is upwardly removable.

3. The combination of claim 2 wherein said container includes holder means removably supporting said pump within said container and for ready upward displacement of said pump from said holder means and upwardly through said open upper end of said container.

4. The combination of claim 1 wherein said air conduit means includes an air line extending downwardly from the upper end of said well and having said air outlet on its lower end.

5. The combination of claim 4 wherein said air line includes a section thereof, above said air outlet, secured to said container.

6. The combination of claim 1 including a well cap closing the upper end of said well, and an air and gas venting standpipe having its lower end opening downwardly through said well cap.

7. The combination of claim 6 wherein said water inlet is defined by an open upper end of said container through which said pump is upwardly removable.

8. The combination of claim 7 wherein said container includes holder means removably supporting said pump within said container and for ready upward displacement of said pump from said holder means and upwardly through said open upper end of said container.

9. The combination of claim 1 wherein said air pump means is disposed exteriorly of the upper end of said well.

* * * * *